US011988052B2

(12) United States Patent
Affleck et al.

(10) Patent No.: US 11,988,052 B2
(45) Date of Patent: May 21, 2024

(54) METHODS AND APPARATUS FOR DEPLOYMENT OF LARGE LOST CIRCULATION MATERIAL OBJECTS

(71) Applicant: SAUDI ARABIAN OIL COMPANY, Dhahran (SA)

(72) Inventors: Michael Anthony Affleck, Aberdeen (GB); Graham Richard Hitchcock, Aberdeen (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/819,570

(22) Filed: Aug. 12, 2022

(65) Prior Publication Data

US 2023/0108571 A1 Apr. 6, 2023

Related U.S. Application Data

(60) Provisional application No. 63/248,154, filed on Sep. 24, 2021.

(51) Int. Cl.
*E21B 21/00* (2006.01)
*E21B 27/02* (2006.01)
*E21B 33/13* (2006.01)

(52) U.S. Cl.
CPC ..... *E21B 21/003* (2013.01); *E21B 27/02* (2013.01); *E21B 33/13* (2013.01)

(58) Field of Classification Search
CPC ..... E21B 21/003; E21B 27/02; E21B 29/00; E21B 33/13; E21B 33/138; E21B 2200/08
See application file for complete search history.

(56) References Cited

U.S. PATENT DOCUMENTS 5,611,400 A * 3/1997 James ..... E21B 27/02 166/292
7,891,424 B2 * 2/2011 Creel ..... E21B 27/02 166/295
8,307,916 B1 * 11/2012 Wald ..... E21B 21/003 166/292
9,091,124 B2 * 7/2015 Hashem ..... E21B 17/00
10,323,464 B1 6/2019 Al-Abduljabbar
(Continued)

FOREIGN PATENT DOCUMENTS

WO 2008/005289 A2 1/2008

OTHER PUBLICATIONS

International Search Report and Written Opinion issued in International Application No. PCT/US2022/044583, dated Nov. 18, 2022 (15 pages).

*Primary Examiner* — Tara Schimpf
*Assistant Examiner* — Jennifer A Railey
(74) *Attorney, Agent, or Firm* — Osha Bergman Watanabe & Burton LLP

(57) ABSTRACT

A method, and related apparatus, involves providing one or more drill pipe segments and disposing a quantity of lost circulation material objects within the one or more drill pipe segments. A retention element is provided to retain the lost circulation material objects within the one or more drill pipe segments. The one or more drill pipe segments are connected to a drill string at a wellbore, and drilling fluid is flowed through the drill string. The flowing of drilling fluid through the drill string causes the retention element to release the lost circulation material objects to propagate further.

21 Claims, 10 Drawing Sheets

(56) References Cited

U.S. PATENT DOCUMENTS

| | | | | |
|---|---|---|---|---|
| 11,078,748 | B2 | 8/2021 | Hitchcock | |
| 2016/0060972 | A1* | 3/2016 | Kos | E21B 17/1064 175/325.2 |
| 2019/0017345 | A1 | 1/2019 | Brandsdal | |
| 2021/0054716 | A1* | 2/2021 | Al-Mousa | E21B 33/13 |
| 2021/0189811 | A1* | 6/2021 | Harbi | C09K 8/516 |
| 2021/0238942 | A1 | 8/2021 | Stratton et al. | |
| 2021/0254450 | A1 | 8/2021 | Hitchcock et al. | |

* cited by examiner

METHODS AND APPARATUS FOR DEPLOYMENT OF LARGE LOST CIRCULATION MATERIAL OBJECTS

BACKGROUND

Various challenges are often encountered during drilling and production operations of a hydrocarbon production well (e.g., a well for oil or gas production). For example, in a phenomenon known as "lost circulation", fluids used in the drilling, completion, or servicing of a wellbore can be lost to the subterranean formation while circulating the fluids in the wellbore. Particularly, by way of mere example, the fluids may enter the subterranean formation via depleted zones, zones of relatively reduced pressure (as compared to the wellbore), zones having naturally occurring fractures, or zones having fracture gradients exceeded by the hydrostatic pressure of the drilling fluid. Such lost circulation is often associated with problems with well control, borehole instability, pipe sticking, unsuccessful production tests, poor hydrocarbon production after well completion, and formation damage due to plugging of pores and pore throats by mud particles. Lost circulation problems may also contribute to non-productive time for a drilling operation and, in extreme cases, may force abandonment of a well entirely.

As a preventative measure or as a remedy, it is thus generally known to deploy lost circulation material (LCM) into a wellbore from the surface, for a purpose inhibiting the loss of drilling fluid (often referred to as "mud") into physically vulnerable parts of a wellbore such as fractures or highly permeable formations. Typically, LCM objects may assume a variety of sizes and shapes (e.g., granular shapes) and are added to the mud at a surface location for circulation downhole, through the piping of a drill string. Then, in the return flow of mud to the surface location from the downhole distal end of the drill string (e.g., from where a drill head is located), typically through an annular volumetric space between the external surfaces of the drill string and the interior surface of the wellbore, the objects effectively "plug" the noted vulnerable portions or inhibit the possibility of mud flow into such portions. Some common examples of LCM objects include tree bark, shredded cane stalks, pieces of plastic or cellophane, or ground material such as ground limestone or marble, wood, corn cobs and cotton hulls.

Conventionally, a variety of LCM types and related loss curing systems have been conceived of, developed and implemented, yet there are often physical limitations presented in their deployment. Particularly, conventional LCM deployment techniques are often not conducive to effectively circulating larger-scale LCM objects (also referred to herein as "large LCM objects"), thus often limiting the size of such objects that may be used. Such larger objects are often employed for "severe" or "total" lost circulation scenarios (e.g., losses greater than 100 barrels per hour), where significant wellbore irregularities or vulnerabilities cause a significant loss of drilling fluid if left untreated. As such, large LCM objects (particles or shapes of materials with sizes greater than 10 mm in diameter) cannot typically be passed through standard mud pumps (that pump mud or drilling fluid downhole via the drill string and uphole via the aforementioned annulus), as the pumps might easily destroy or break the particles down. Another concern may be encountered with harder LCM objects, which could cause damage to the pumps themselves.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method that includes providing one or more drill pipe segments and disposing a quantity of lost circulation material objects within the one or more drill pipe segments. A retention element is provided to retain the lost circulation material objects within the one or more drill pipe segments. The one or more drill pipe segments are connected to a drill string at a wellbore, and drilling fluid is flowed through the drill string. The flowing of drilling fluid through the drill string causes the retention element to release the lost circulation material objects to propagate further.

In one aspect, embodiments disclosed herein relate to an apparatus for deploying lost circulation material objects into a wellbore. The apparatus includes one or more drill pipe segments, a quantity of lost circulation material objects disposed within the one or more drill pipe segments and a retention element that retains the lost circulation material objects within the one or more drill pipe segments. The flowing of drilling fluid through the one or more drill pipe segments causes the retention element to release the lost circulation material objects to propagate further.

In one aspect, embodiments disclosed herein relate to a method that includes providing one or more drill pipe segments and disposing a quantity of lost circulation material objects within the one or more drill pipe segments. A dissolvable retention element is provided to retain the lost circulation material objects within the one or more drill pipe segments. The flowing of drilling fluid through the one or more drill pipe segments causes the retention element to structurally disintegrate and release the lost circulation material objects to propagate further.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
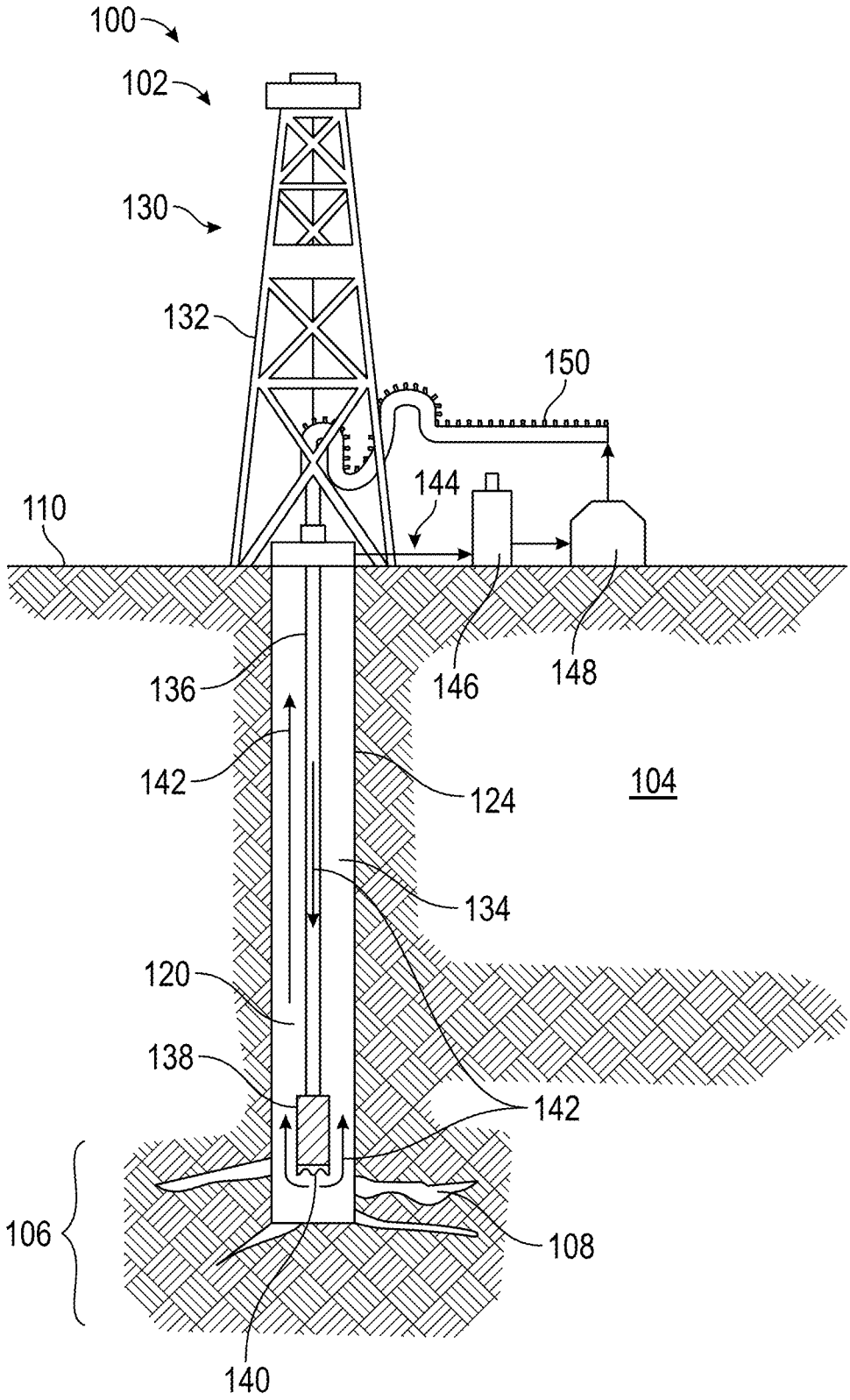
FIG. 1 schematically illustrates, in a general and cross-sectional elevational view, a well environment of oil and gas extraction by way of general background and in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Broadly contemplated herein, in accordance with one or more embodiments, are methods and apparatus for deploying into a wellbore large LCM objects (e.g., greater than 10 mm in diameter, and where a majority of the objects are so sized) that would be difficult to pass through equipment such as a conventional (e.g., centrifugal) charge pump or mud circulation pump (e.g., which may often be a positive displacement pump). Thus, the features broadly contemplated herein may be employed for deploying LCM objects that otherwise may become damaged by mechanisms in pumping systems or valve arrangements, or could potentially cause some damage to such mechanisms.

Turning now to the figures, to facilitate easier reference when describing FIGS. 1 through 11, reference numerals may be advanced by a multiple of 100 in indicating a similar or analogous component or element among FIGS. 1-11.

FIG. 1 schematically illustrates, in a general and cross-sectional elevational view, a well environment 100 of oil and gas extraction by way of general background and in accordance with one or more embodiments.

As illustrated, formation 104 may include a porous or fractured rock formation that resides underground, beneath the surface 110 of the Earth. The surface 110 may be dry land or ocean bottom. The well system 102 may be for a hydrocarbon well, such as an oil well, a gas well, a gas condensate well, or a mixture of hydrocarbon-bearing fluids. The formation 104 may include different layers of rock having varying characteristics, such as degrees of density, permeability, porosity, and fluid saturations. The formation 104 may include a low-pressure formation (for example, a gas-depleted former hydrocarbon-bearing formation) and a water-bearing formation (for example, fresh water, brine, former waterflood). In the case of the well system 102 being operated as a production well, the well system 102 may facilitate the extraction of hydrocarbons (or "production") from a hydrocarbon-bearing formation. In the case of the well system 102 being operated as an injection well, the well system 102 may facilitate the injection of substances, such as gas or water, into a hydrocarbon-bearing formation.

The well system 102 may include a wellbore 120 and a drilling system 130. "Wellbore" may also be referred to as a "subterranean wellbore". The wellbore 120 may include a bored hole that extends from the surface 110 into the formation 104. Wellbore 120 is defined by wellbore wall 124, generally cylindrical in shape. Although shown as a completely vertical well, the path of wellbore 120 may alter to assume a deviated (sloped) or horizontal configuration, starting from a predetermined subsurface location.

The wellbore 120 may be created, for example, by the drilling system 130 boring through the formation 104. The drilling system 130 may include a drilling rig 132 and a drill string 134. The drill string 134 may include a drill pipe 136 and a bottom hole assembly (BHA) 138 which may include a drill bit 140. The BHA may also include drill collars, stabilizers and reamers. In accordance with a working example, the drill bit 140 includes a cutting drill bit having rotating teeth that can bore through the formation 104 to create the wellbore 120.

The wellbore 120 may provide for the circulation of "drilling fluids" or "drilling mud" (or simply "mud") 142 during drilling operations using a mud circulation system 144. The terms "drilling fluid", "drilling mud" and "mud" refer to fluids, slurries, or muds used in drilling operations downhole, such as during the formation of the wellbore.

Drilling fluid 142 flows downhole through the drill string 134, out of the drill bit 140 (thus cooling the drill bit 140 from the heat of friction generated from cutting action against the face of the wellbore 120), and back uphole through an annular chamber defined between the drill string 134 and the wellbore wall 124 of the wellbore 120, carrying cuttings and other debris from the bottom of the wellbore 120. Upon reaching the surface 110, the drilling fluid 142 may pass through a drilling fluid return line 144 into a drilling fluid receiving tank 146, where the cuttings are separated from the drilling fluid 142. In the drilling fluid receiving tank 146, the drilling fluid 142 is agitated (e.g., via mud cleaning equipment or a shale shaker such as that indicated at 245 in FIG. 2), such that it releases any dissolved gases from the drilling fluid 142. The drilling fluid 142 is then passed to a drilling fluid storage tank and associated mud pump (jointly indicated at 148); the fluid 142 thus is held there until it is pumped back to the drill string 134 via a standpipe 150 and then back downhole once again.

Lost circulation, or loss of circulation, is said to have occurred when the drilling fluid 142 flows into formation 104 through fractures 108 (or other structural irregularities or anomalies) instead of returning up the aforementioned annulus. In the present disclosure, "fractures" may refer to as naturally occurring opening or fissure in the formation, fissures created by the drilling activities, or any other features of the formation in the vicinity of the wellbore which allow the migration of the drilling fluid into the formation. The general location where the fluid is being lost into the formation 104 may be referred to as a lost circulation zone 106. The lost circulation zone 106 of the embodiment illustrated in FIG. 1 is located in the bottom portion of the wellbore 120. However, lost circulation may occur at any location in the wellbore 120 between the surface 110 and the bottom of the wellbore 120 and thus, any parts of the wellbore 120 where lost circulation is occurring may be considered as the lost circulation zone (or zones) 106. Lost circulation may be classified under different categories based on the amount of drilling fluid being lost and may include: "seepage"; "partial lost returns" (or "partial loss", or "partial lost circulation"); "severe lost returns" (or "severe loss", or "severe lost circulation"); and "total lost returns" (or "total loss", or "total lost circulation).

The disclosure now turns to working examples of a system and method in accordance with one or more embodiments, as described and illustrated with respect to FIGS. 2-11. It should be understood and appreciated that these merely represent illustrative examples, and that a great variety of possible implementations are conceivable within the scope of embodiments as broadly contemplated herein.

Figure 2:
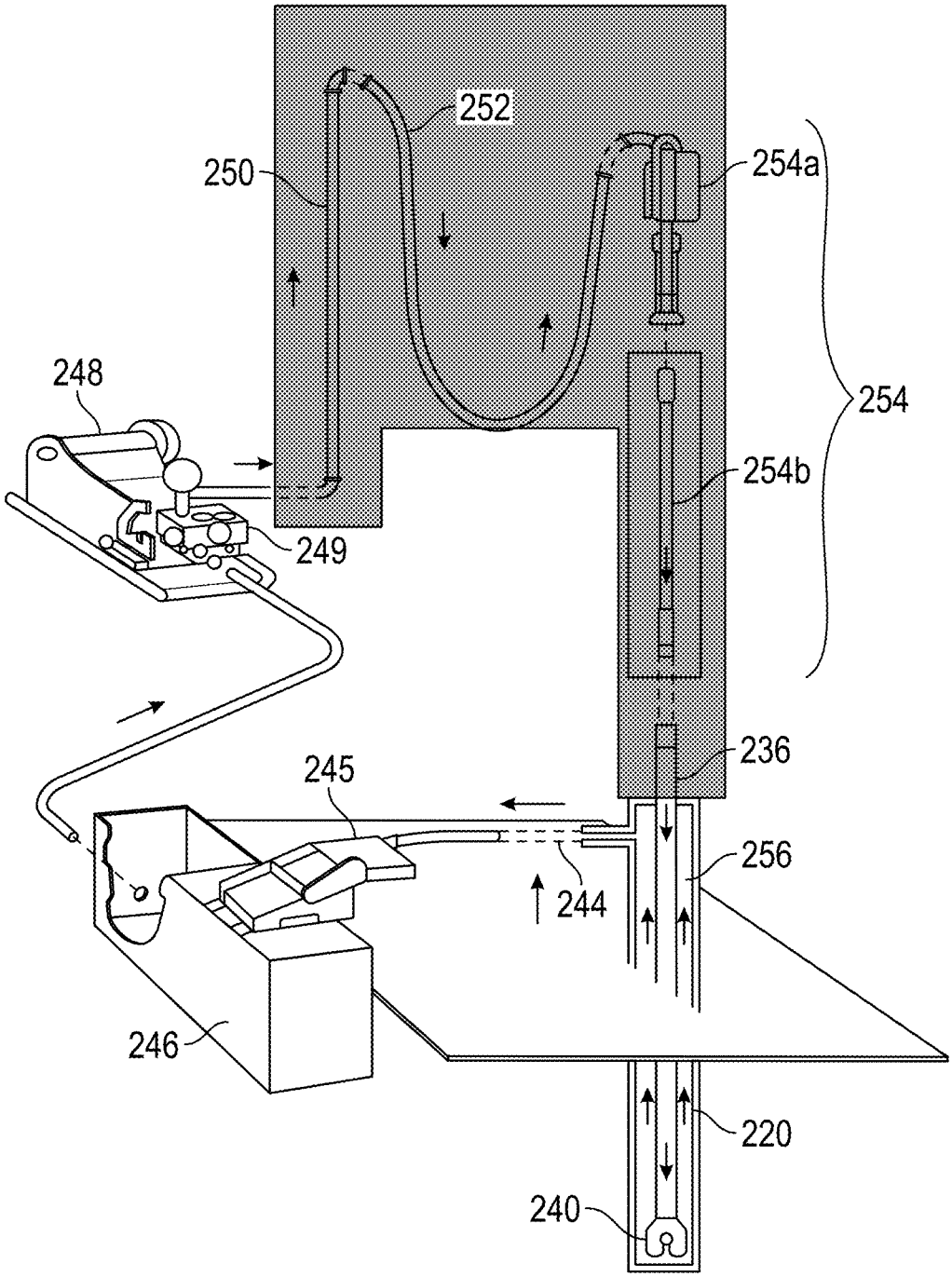
FIG. 2 schematically illustrates a system for circulating drilling fluid, in accordance with one or more embodiments.

In accordance with one or more embodiments, FIG. 2 schematically illustrates a conventional system for circulating drilling fluid (or "mud"), in which methods and apparatus for the deployment of large LCM objects as broadly contemplated herein may be employed. As illustrated, the downhole propagation of drilling fluid is indicated with arrows oriented in a general direction between mud pump 248 (with an incorporated drilling fluid storage tank) and drill bit 240, and its return flow is indicated with arrows oriented in a general direction between drill bit 240 and mud pump 248. As such, while a mud tank or pit 246 (or "drilling fluid receiving tank") stores drilling fluid that is initially provided or has been recirculated, mud pump 248 (in fluid communication therewith) pumps the drilling fluid onward through a pump discharge line 249, standpipe 250 and rotary hose 252.

As generally is known, and in accordance with one or more embodiments, different arrangements may be provided for providing torque to rotationally drive a drill string (and thus drill bit 240); two alternatives are indicated generally at 254 in FIG. 2. Thus, the rotary hose 252 may feed into (or through) a top drive 254*a* which itself provides torque to the drill string in order to drill a borehole. As also is generally known, a kelly drive 254*b* may be provided as an alternative to a top drive 254*a*. Such an arrangement uses a section of pipe with a polygonal or splined outer surface, which passes through a matching bushing and rotary table; the bushing is then rotated via the rotary table to also rotate the drill string.

In accordance with one or more embodiments, the drill string (as generally known) includes segments of drill pipe 236 that are axially connected to one another (e.g., via suitable male and female threading at respective axial ends of each segment). Interconnected segments of drill pipe 236 are disposed to rotate within wellbore 220, to rotationally drive the drill bit 240 via transferring torque thereto. As such, while drilling fluid supplied by pump (and tank) 248 propagates through drill pipe 236 toward the drill bit 240 (generally downwardly) as shown, it returns (generally upwardly) through an annulus 256 defined between the drill pipe 236 and inner wall of the wellbore 220, also via pumping by the pump 248. In the process, the drilling fluid then returns to receiving tank 246 via mud return line 244, and via mud cleaning equipment or shale shaker 245.

By way of further background in accordance with one or more embodiments, LCM objects are normally introduced into the drilling fluid flow so as to propagate downhole through the segments of drill pipe 236 and uphole through the annulus 256, to then become lodged into the structural anomalies of one or more lost circulation zones (e.g., as indicated at 106 in FIG. 1) to prevent or mitigate any further loss of drilling fluid to such anomalies.

As such, by way of additional background in accordance with one or more embodiments, the grey shaded area in FIG. 2 represents that greatly restricted portion of the mud (drilling fluid) circulation system where large LCM objects (such as custom "severe" or "total" LCM objects) would need to be introduced in order to avert the risk of their damage by the pump 248, or of damaging the pump 248 itself. Thus, the noted area is between the mud pump 248 and the beginning of the downhole portion of the drill string. However, the introduction of large LCM objects into the drilling fluid flow within the grey-shaded region presents its own difficulties and challenges. Particularly, as this would represent the "high-pressure" side of the mud pump 248, the inclusion of a suitable pressure-rated vessel and volume transfer system would be needed for safety reasons, adding considerable complexity and cost to the system.

Figure 3A:
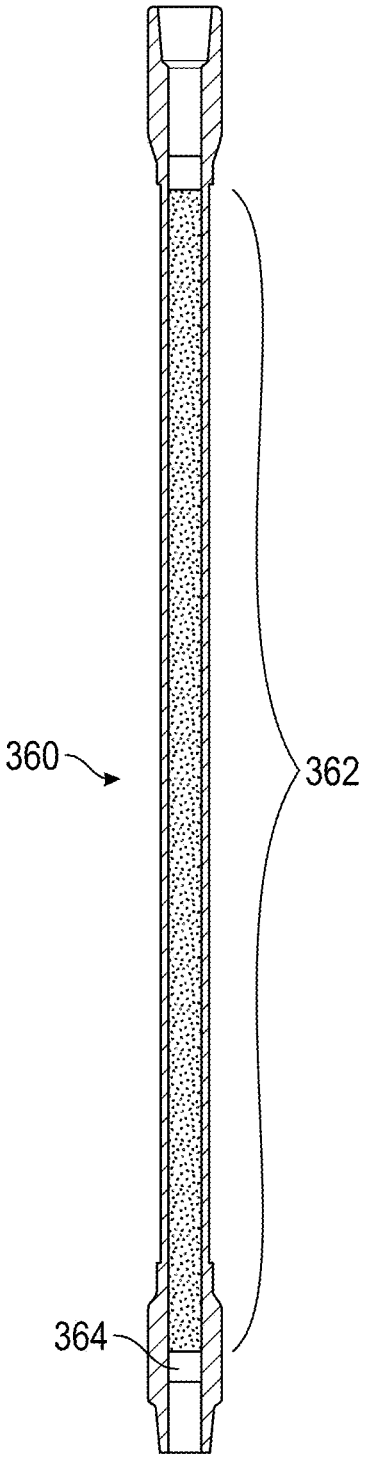
FIG. 3A schematically illustrates, in a cross-sectional elevational view, a section of drill pipe with a plug installed and charged with large LCM objects, in accordance with one or more embodiments.

In accordance with one or more embodiments, one or more drill pipe segments may be preconfigured to include a quantity of large LCM objects, to permit the introduction of such objects into the wellbore 220 outside of (and downhole from) the grey-shaded area in FIG. 2, thus averting and obviating the difficulties and challenges noted above. Accordingly, FIG. 3A schematically illustrates, in cross-sectional elevational view, a segment 360 of drill pipe so configured. Essentially, this may be a conventional segment of drill pipe, with modifications, that can be added to a drill string along with other segments of drill pipe. Thus as shown, a quantity of large LCM objects 362 can be disposed in an interior portion defined within the drill pipe segment 360, held therewithin by a plug 364 (itself, installed toward a lower or downhole distal end of the segment 360). As discussed in more detail herebelow, the plug 364 may be temporary in its nature and implementation, e.g., formed from a dissolvable material.

In accordance with one or more embodiments, the preconfigured drill pipe segment 360 may be disposed essentially anywhere along the drill string as may be deemed suitable, including toward a lowermost end of the drill string (e.g., axially adjacent to a bottomhole assembly that includes a drill bit such as that indicated at 240 in FIG. 2). Additionally, more than one preconfigured drill pipe segment 360, each with its own plug 364, may be included in the drill string.

As such, in accordance with one or more embodiments, one or more preconfigured drill pipe segments 360 may be added to the drill string essentially at any time deemed suitable. Thus, as lengths of drill pipe are continually added with deeper drilling of the well, one or more new preconfigured drill pipe segments 360 may be added right into the drill string when the circulation of drilling fluid stops, in essentially the same manner that standard drill pipe segments (without LCM objects contained therein) would be added. The one or more preconfigured drill pipe segments 360 thus serve as a type of pressure-rated "container" for the LCM objects, until the objects are flushed out from the drill pipe segment(s) 360 via the flow of drilling fluid when it restarts (and in a manner as variously described herein). The operators on-site can readily determine when the addition of one or more new preconfigured drill pipe segments 360 may be warranted, e.g., in response to detected drilling fluid losses during drilling. As such, the number of preconfigured drill pipe segments 360 added at any given time can be governed by a magnitude of detected drilling fluid losses and based on an understanding of a quantity of LCM objects that may need to be introduced in response.

Figure 3B:
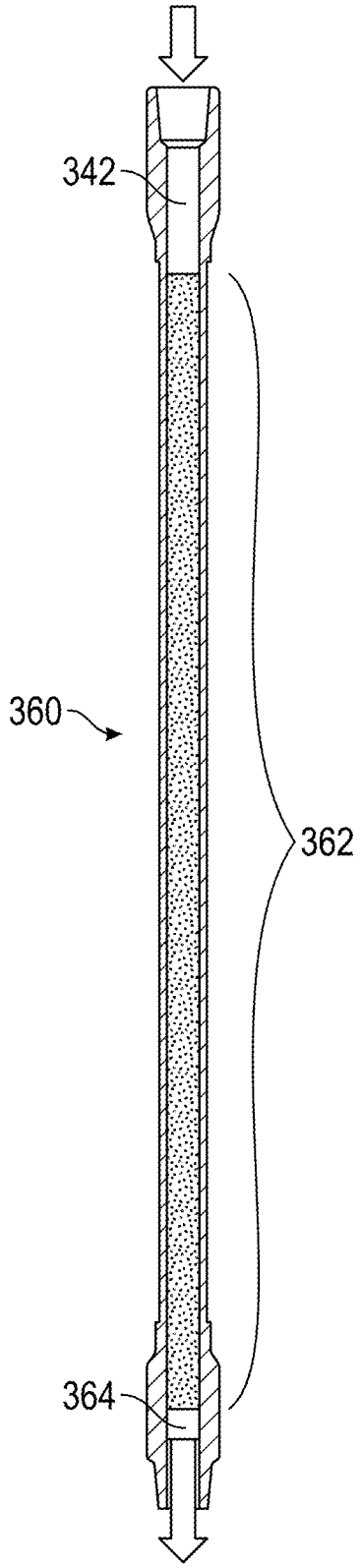
FIG. 3B provides substantially the same view as FIG. 3A, but showing the introduction of drilling fluid into the drill pipe segment, in accordance with one or more embodiments.

In accordance with one or more embodiments, FIG. 3B provides essentially the same view as FIG. 3A, but showing the introduction of drilling fluid 342 into the interior of the drill pipe segment 360. In this process, the LCM objects 362 are wetted, while the plug 364 may include perforations or throughholes, extending from one axial end of the plug 364 to the other, to permit the fluid 342 to flow therethrough.

Figure 3C:
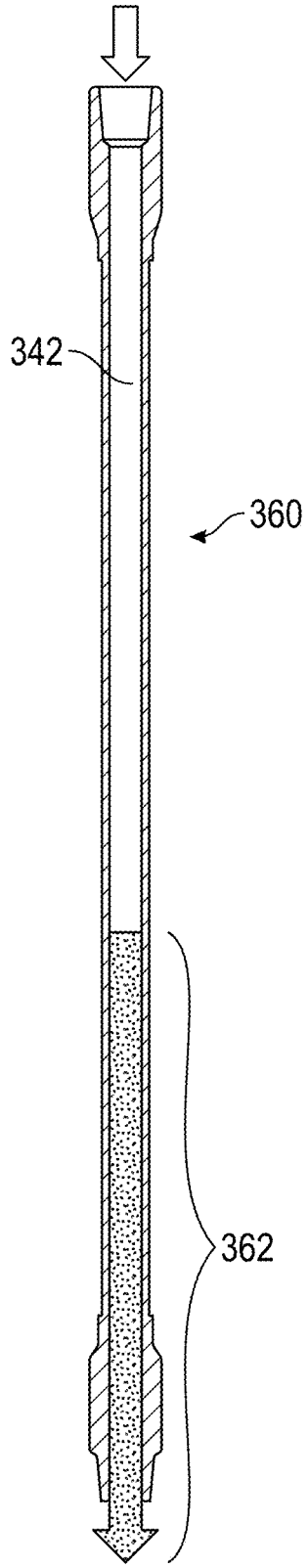
FIG. 3C provides substantially the same view as FIGS. 3A and 3B, but showing the throughflow of large LCM objects through the drill pipe segment after dissolution of the plug, in accordance with one or more embodiments.

As such, FIG. 3C provides essentially the same view as FIGS. 3A and 3B, but showing the throughflow of LCM objects 362 through the drill pipe segment after dissolution of the plug 364, in accordance with one or more embodiments. Thus, with the plug (not shown in FIG. 3C) fully dissolved, the quantity of LCM objects 362 now are able to propagate through the drill pipe segment 360 uninhibited.

Figure 4A:
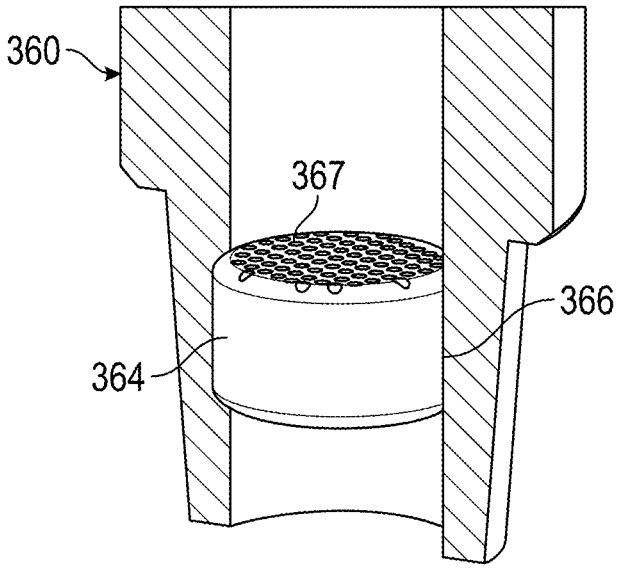
FIG. 4A schematically illustrates the plug and portion of the drill pipe segment from FIG. 3A in a partly cross-sectional, isometric view, in accordance with one or more embodiments.
Figure 4B:
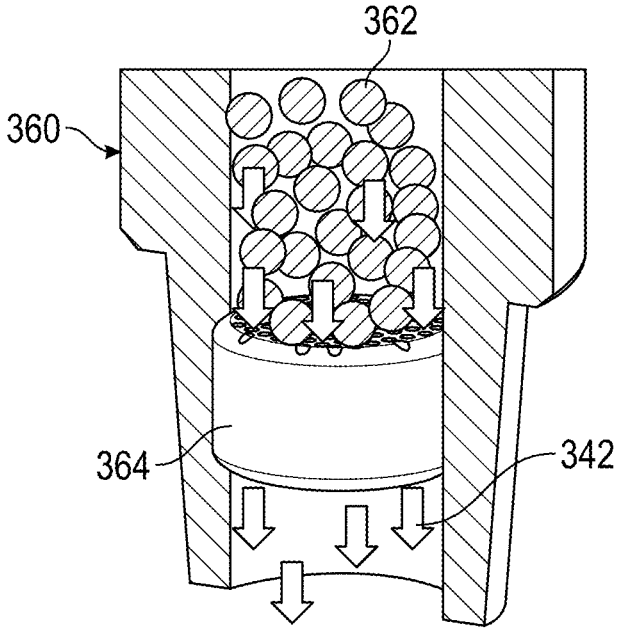
FIG. 4B provides substantially the same view as FIG. 4A, but showing the drilling fluid progressing through perforations in the plug and large LCM objects retained above the plug, in accordance with one or more embodiments.

In accordance with one or more embodiments, FIG. 4A shows the plug 364 and a portion of drill pipe segment 360 from FIG. 3A in a cross-sectional, isometric view. As shown, the plug 364 may be fixed within the interior of drill pipe segment 360 via a dissolvable adhesive 366. FIG. 4B then shows essentially the same view as FIG. 4B, but with drilling fluid 342 progressing through perforations in the dissolvable plug 364 and large LCM objects 362 retained above the plug 364 (prior to the plug 364 dissolving).

In accordance with one or more embodiments, plug 364 may be formed from one or more rapidly dissolvable materials. A great variety of materials can be employed here, including several used extensively in the packaging industry. By way of illustrative and non-restrictive example, such materials can include starch, paper, wood pulp and polyvinyl alcohol (PVOH). They typically can be formed into solid objects, foamed objects, single strand fibers, woven cloth and other forms, and thus can readily be formed into a suitable shape for a dissolvable plug 364 as broadly contemplated herein. Further, while such a dissolvable plug 364 could be formed completely from one or more dissolvable materials, in accordance with at least one variant it could be formed from a dissolvable binder and small-particle powder, such that the overall structure collapses as soon as the binder dissolves.

In accordance with one or more embodiments, and as noted previously, the dissolvable plug 364 may be perforated with a plurality of throughholes or flow channels extending from one axial end of the plug 364 to the other; entry portions of such holes/channels are indicated generally at 367 in FIG. 4A, at an upper axial end of plug 364. The holes or channels 367 may be suitably sized to permit at least some degree of throughflow of drilling fluid 342 while preventing the throughflow of LCM objects. Thus, and as appreciated further from FIG. 4B, the holes/channels 367 may be sized such that they are generally smaller than the smallest LCM objects being used, to permit at least some throughflow of drilling fluid 342 while the LCM objects 362 are retained axially above the plug 364 and are wetted by the drilling fluid 342. By way of illustrative example, the flow channels could have any of a variety of geometric cross-sectional shapes, such as circular, triangular or rectangular. In accordance with one or more variant embodiments, a plug 364 may be formed without throughholes or channels (such as those indicated at 367) and instead may be configured simply to break or fail mechanically, whereupon the plug (or fragments thereof) then dissolve as the plug (or its fragments) continue to flow downhole.

Figure 5A:
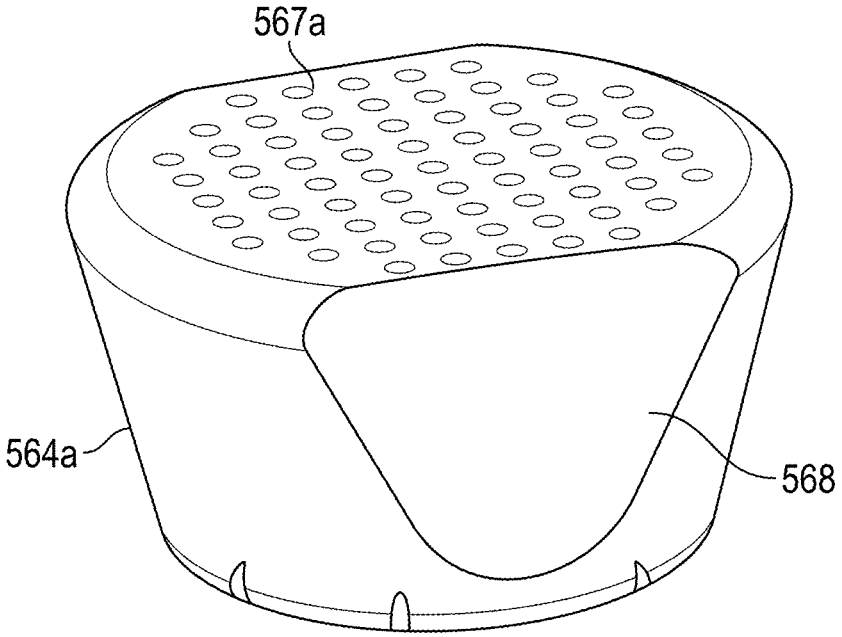
FIGS. 5A, 5B and 5C respectively illustrate three examples of dissolvable plugs in isometric view, in accordance with one or more embodiments.

In accordance with one or more embodiments, a dissolvable plug may be installed within a drill string without an adhesive, e.g., via an interference fit or form fit. Accordingly, FIG. 5A illustrates a plug 564*a*, in isometric view, with a tapered external surface (from top to bottom in the drawing) and a pair of generally triangular flat indentations 568 recessed therein (one of which is visible in FIG. 5A). Also shown are entry portions of throughholes/channels 567*a*, at an upper axial end of plug 564*a*. By way of illustrative example, plug 564*a* may be positioned at an internal portion of a drill pipe segment, such as a drill pipe upset portion.

Figure 5B:
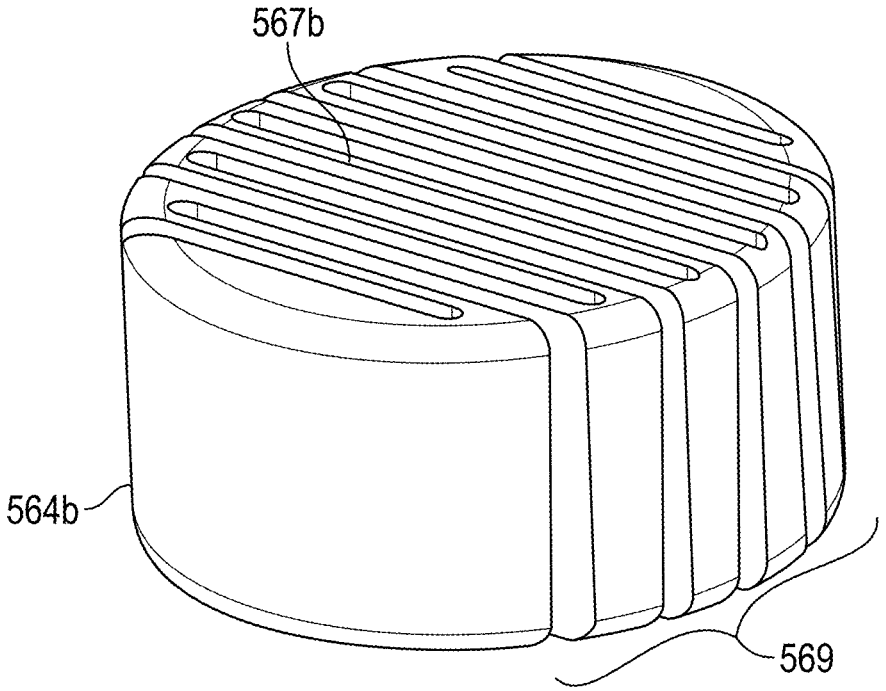

As an alternative, in accordance with one or more embodiments, FIG. 5B illustrates a plug 564*b*, in isometric view, that is generally cylindrical in shape. Here, plug 564*b* may include a number of slot-shaped channels 567*b*, extending from an upper axial end to a lower axial end of plug 564*b*. As shown, entry portions of such channels 567*a* may extend across the generally circular upper axial surface of plug 564*b* in the manner of a secant. In the present working example, some such channels 567*a* (here, alternate ones of them) extend only incompletely across the full lateral extent of the plug 564*b*, while a subset 569 of the channels 567*a* extend completely across the full lateral extent of the plug 564*b*. Plug 564*b* can be positioned, e.g., to sit on an internal taper of a drill pipe segment and can be sufficiently elastic in its formulation as to be fixed thereby as an interference fit.

Figure 5C:
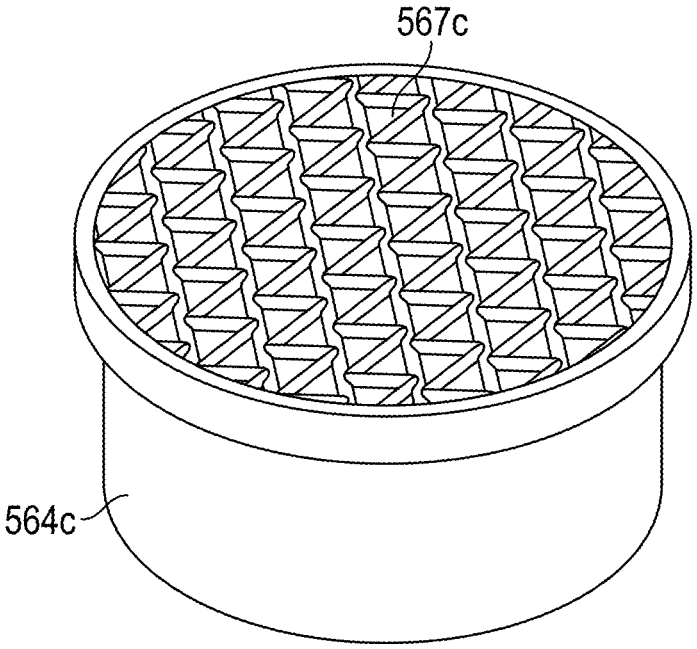
Figure 5D:
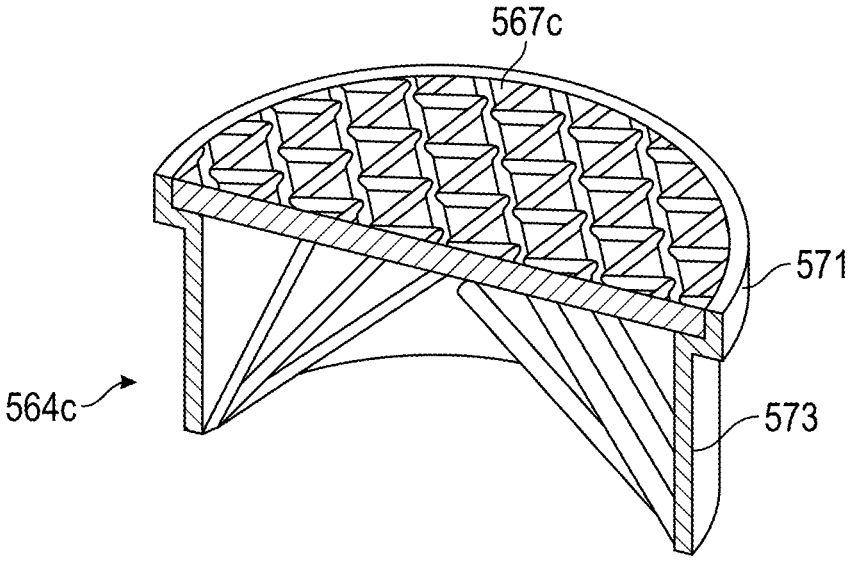
FIG. 5D provides a cross-sectional view of the plug shown in FIG. 5C.

As another alternative, in accordance with one or more embodiments, FIGS. 5C and 5D jointly illustrate a plug 564*c* (in isometric view and cross-sectional isometric view, respectively), that is also generally cylindrical in shape. Here, plug 564*c* may include an upper disc-shaped cap portion 571, and a lower generally cylindrical portion 573. Upper portion 571 may include a latticework of structural portions which intersect and define therebetween triangular-shaped indentations 567*c*; these may be entry points to throughholes or channels as discussed herein or, in a variant embodiment, may be fully closed (and still subject to dissolution upon the introduction of drilling fluid). Lower portion 573, for its part, may be structured with support elements as shown, which would be configured to break mechanically and then dissolve along with the rest of the plug 564*c*.

Figure 6:
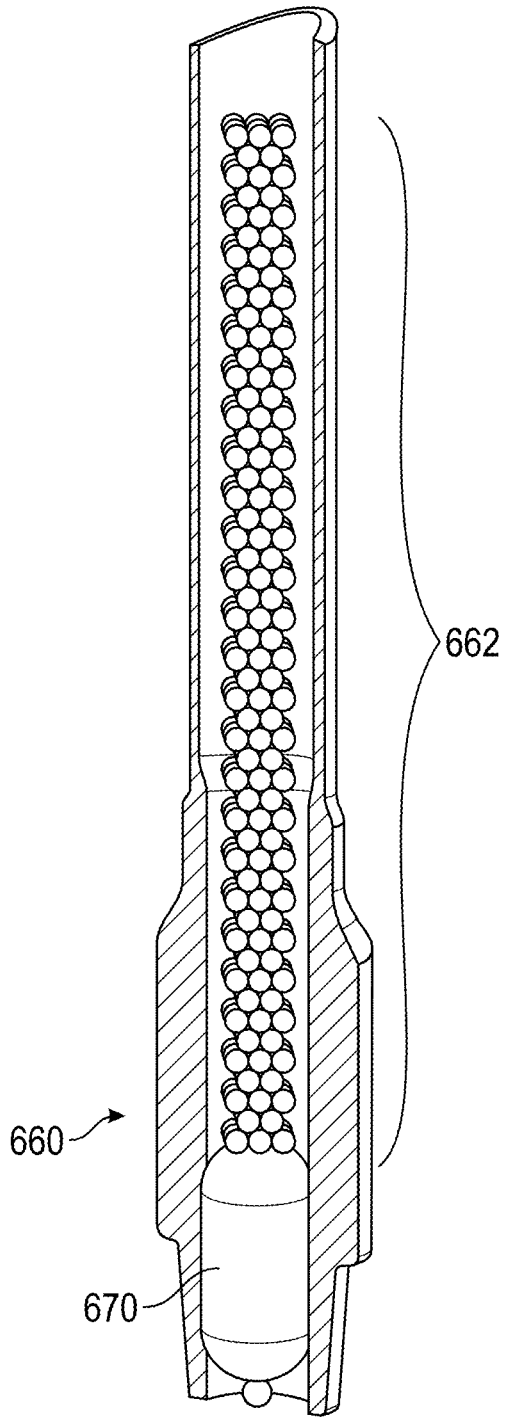
FIG. 6 illustrates, in a partly cross-sectional, isometric view, a first variant configuration of a drill pipe segment and LCM object retention element in accordance with one or more embodiments.

FIG. 6 illustrates, in a partly cross-sectional, isometric view, a first variant configuration of a drill pipe segment 660 and LCM object retention element 670 in accordance with one or more embodiments. Here, instead of a dissolvable plug, and LCM object retention element 670 may be embodied by an inflatable capsule (or "balloon" or "bag") 670 formed from a dissolvable material. Thus, capsule 670 may be generally pill-shaped as shown in FIG. 6, sufficiently large to span the full inner diameter of the interior of drill pipe segment 660, and formed from a thin, dissolvable material such as PVA (polyvinyl alcohol) film. Accordingly, in the configuration of FIG. 6, drilling fluid propagating axially downwardly will wet the large LCM objects 662 and also push the same toward capsule 670 in a manner to rupture and disintegrate the capsule 670, thus then permitting the free and uninhibited flow of LCM objects 662 through drill pipe segment 660. By way of initial implementation, the capsule 670 may be inflated and then disposed within the drill pipe segment 660.

Figure 7:
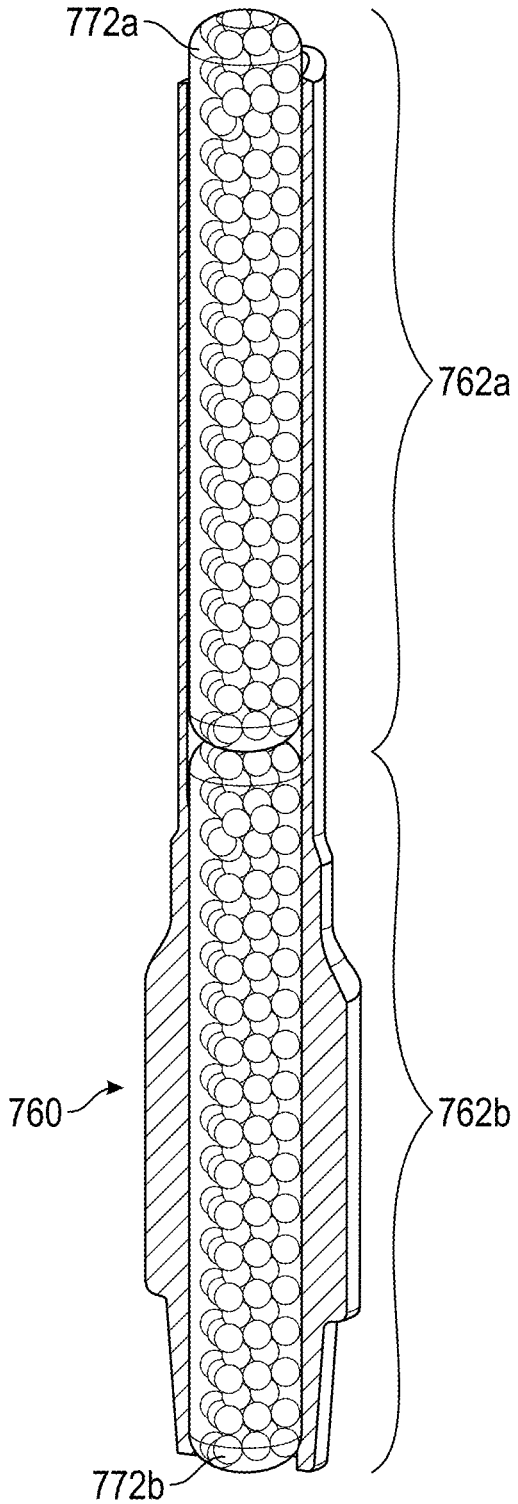
FIG. 7 illustrates, in a partly cross-sectional, isometric view, a second variant configuration of a drill pipe segment and LCM object retention elements in accordance with one or more embodiments.

FIG. 7 illustrates, in a partly cross-sectional, isometric view, a second variant configuration of a drill pipe segment 760 and LCM object retention elements in accordance with one or more embodiments. Here, drill pipe segment 760 may contain two quantities (762*a* and 762*b*) of large LCM objects that are disposed axially adjacent to one another and are each contained within sacks or membranes formed from a dissolvable material (772*a* and 772*b*, respectively). When drilling fluid then propagates into the drill pipe segment 760, the containing sacks 772*a/b* then will dissolve and release the large LCM objects 762*a/b* to proceed (in a downward direction with respect to the drawing) freely and uninhibitedly through the drill pipe segment 760. A non-restrictive example of a possible material for the sacks 772*a/b* is soluble yarn as commonly used in the textile industry, formed (for instance) as PVA fibers held together with soluble resins. By way of initial implementation, at least a portion of the large LCM objects being used (e.g., such as the quantities indicated at 772*a* and 772*b*) may be disposed within a sack (such as 772*a* and 772*b*), and the sack (such as 772*a* and 772*b*) may be disposed within the drill pipe segment 760.

Figure 8:
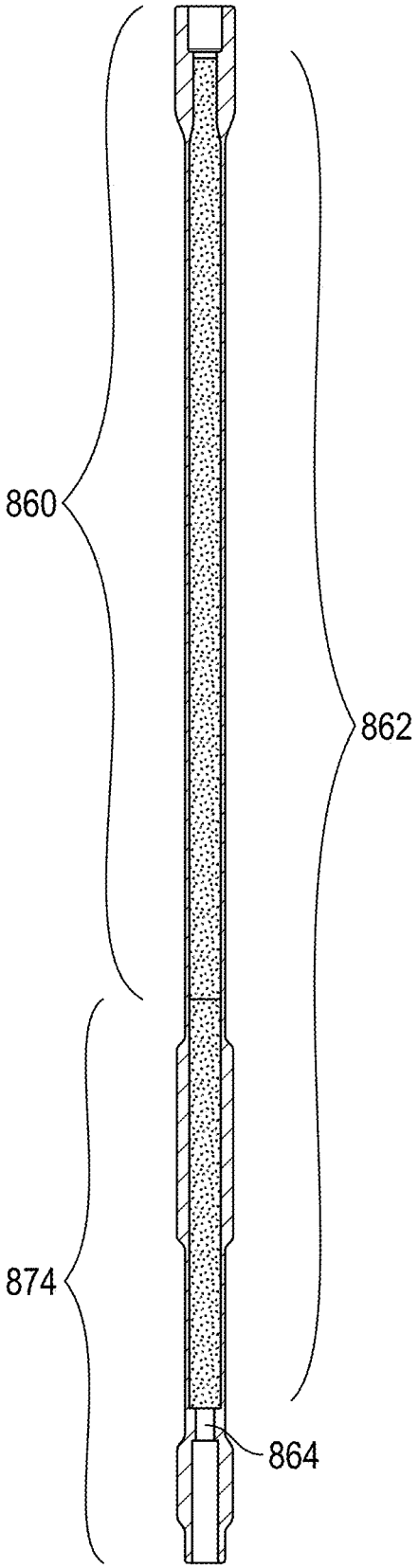
FIG. 8 schematically illustrates, in a cross-sectional elevational view, a configuration including a drill pipe segment and a pup joint, in accordance with one or more embodiments.

FIG. 8 schematically illustrates, in a cross-sectional elevational view, a configuration including a drill pipe segment 860 and a pup joint 874, in accordance with one or more embodiments. (A "pup joint" may be understood to be a drill pipe segment of shorter or non-standard axial length that is used to help adjust the overall length of an assembled drill string to a precise, predetermined requirement.) Here, the pup joint 874 is assembled end-to-end with the drill pipe segment 860. A dissolvable plug 864 is installed in the pup joint 874 substantially as described elsewhere herein, and a quantity of large LCM objects 862 is then disposed behind the plug 864, occupying an interior volumetric space defined jointly by the pup joint 874 and the drill pipe segment 860.

Figure 9:
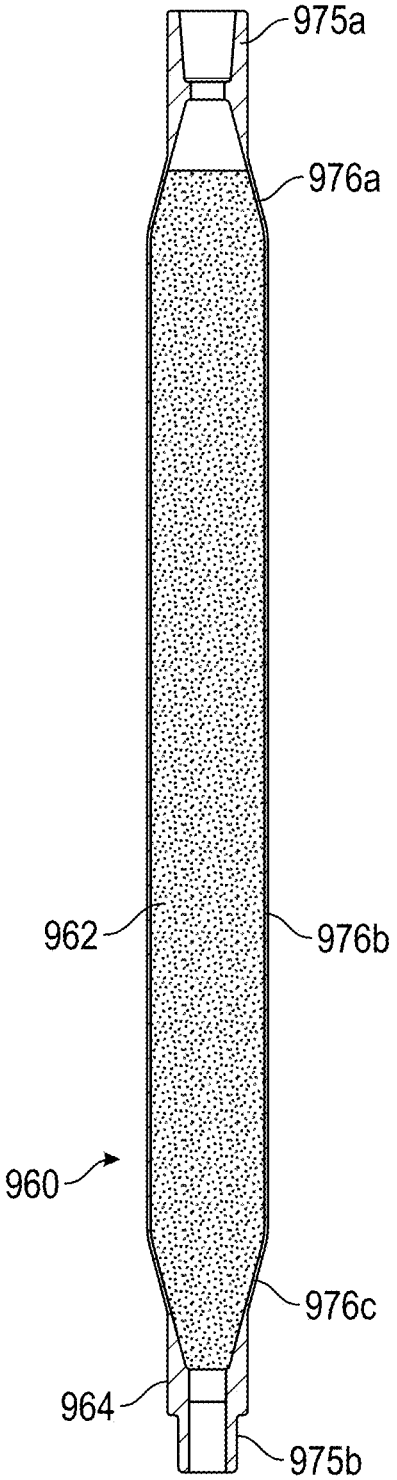
FIG. 9 schematically illustrates, in a cross-sectional elevational view, a configuration including a drill pipe segment with an intermediate axial portion of larger diameter, in accordance with one or more embodiments.

FIG. 9 schematically illustrates, in a cross-sectional elevational view, a configuration including a drill pipe segment 960 that includes an intermediate axial portion of larger diameter, in accordance with one or more embodiments. As shown, drill pipe segment 960 may include upper and lower axial end portions (975*a* and 975*b*, respectively) that are configured and dimensioned similarly to a standard drill pipe segment. Between the upper and lower axial end portions 975*a* and 975*b*, progressing axially downwardly with respect to the drawing, the drill pipe segment 960 may then be embodied in three distinct portions: a first generally transition portion 976*a*, an intermediate portion 976*b* and a second transition portion 976*c*. The intermediate portion 976*b* may be generally cylindrical in shape but of a larger diameter than the upper and lower axial end portions (975*a/b*) of the drill pipe segment 960. Thus, the transition portions 976*a/c* may be generally tapered (or frustoconical) in their external shape, to effectively transition between the larger diameter of the intermediate portion 976*b* and the smaller diameter of each of the axial end portions (975*a/b*), respectively.

It can thus be appreciated that, in accordance with one or more variant embodiments, drill pipe segment 960 can hold a larger quantity of large LCM objects 962 than a standard drill pipe segment, while a dissolvable plug 964 can be used of essentially the same size as in embodiments involving a standard drill pipe segment. It also may be advantageous to install the drill pipe segment 960 at a position in the wellbore that is closer to the surface location than other drill pipe segments, as the larger overall diameter of segment 960 will lend itself better to the likelihood of greater available clearance at such a position in the wellbore.

Additionally, in accordance with one or more embodiments, it should be understood that drill pipe segment 960 need not necessarily be included as a constituent portion of the actual drill string used for performing a drilling operation and thus may serve temporarily as a discharge vessel for large LCM objects 962. In other words, it can be connected temporarily to the drill string at the surface, circulation of drilling fluid may then continue in order to flush out the large LCM objects 962, and the segment 960 can then be disconnected. The segment 960 can still be as long as a standard drill pipe segment, but its diameter at intermediate portion 976*b* may then be considerably large, such that a significantly increased volume of LCM objects 962 (e.g., up to 50 times greater) can be held and then deployed into the drill string.

Figure 10A:
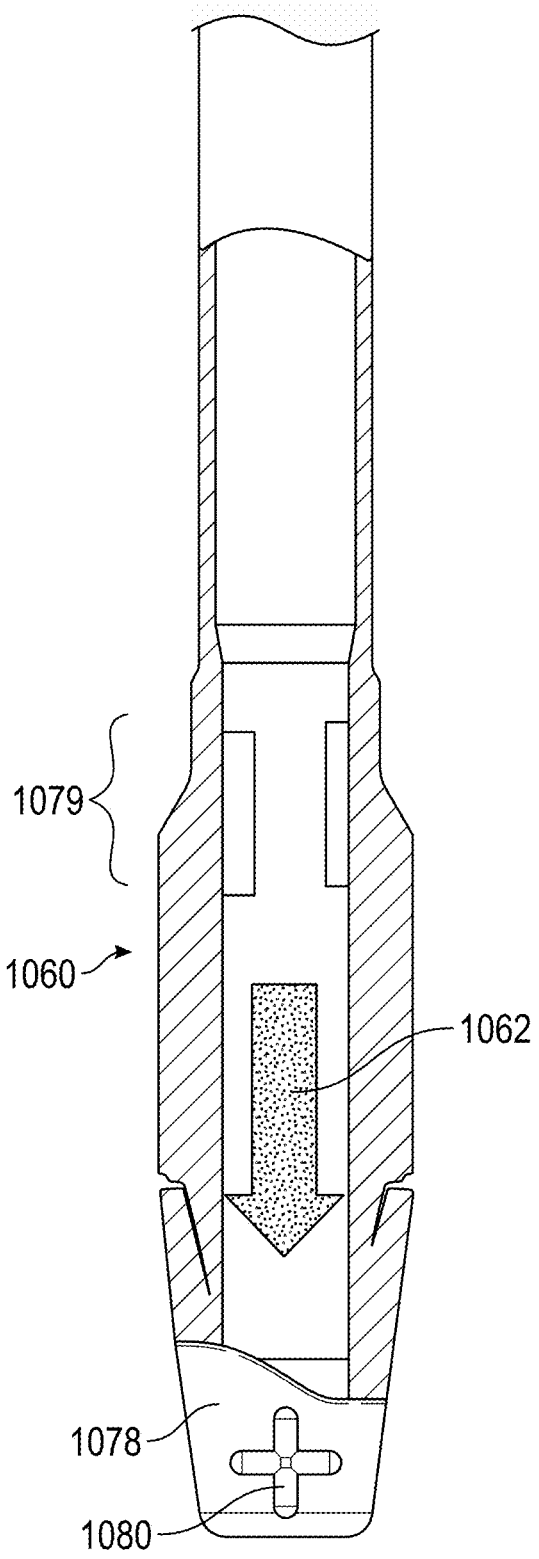
FIG. 10A schematically illustrates, in a partly cross-sectional elevational view, a configuration including a drill pipe segment with a safety cap, in accordance with one or more embodiments.
Figure 10B:
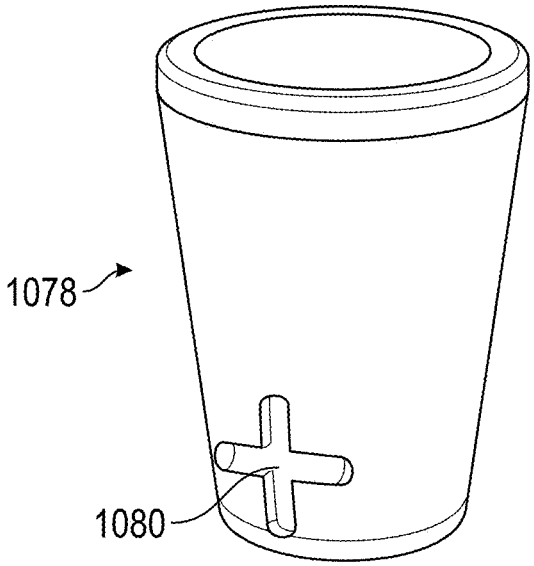
FIG. 10B schematically illustrates, in isometric view, the safety cap from FIG. 10A, in accordance with one or more embodiments.

FIG. 10A schematically illustrates, in a partly cross-sectional elevational view, a configuration including a drill pipe segment with a safety cap, in accordance with one or more embodiments. Additionally, FIG. 10B schematically illustrates, in isometric view, the safety cap from FIG. 10A, in accordance with one or more embodiments. Reference may continue to be made to both FIGS. 10A and 10B jointly.

As shown, a drill pipe segment 1060 may include, at an axial end thereof, a safety cap 1078. As discussed elsewhere herein, the drill pipe segment 1060 may be "pre-charged" and thus include therewithin a quantity of large LCM objects 1062 and a dissolvable plug or analogous component. (The thicker vertical line segments indicated at 1079 may be considered to represent the original location of a dissolvable plug that fails, which would then propagate downwardly toward safety cap 1080. The downward arrow indicating the presence of LCM objects 1062 can likewise be understood to represent the downward propagation of such objects 1062 subsequent to plug failure.) The safety cap 1078 may generally be in the form of a thread protector, that is, providing a known function of protecting internal or external threads of the pipe segment 1060 during transportation and storage. The cap 1078 may be formed from a lightweight load-bearing material such as aluminum or a metal composite. The cap 1078 may also be color-coded for ready identification as a "pre-charged" drill pipe segment.

As such, in accordance with one or more embodiments, in the event of premature structural failure of the dissolvable plug (or other analogous component) inside, the plug (or other component) or the LCM objects 1062 would move into an interior portion of the safety cap 1078, which then prevents the LCM objects 1062 from discharging from the drill pipe segment 1060 during handling. Additionally, one or more small windows 1080 can be provided to permit a degree of observation (or permit viewing) into the interior of the safety cap 1078, to verify visually whether any LCM objects 1062 or material from the plug (or other component) are disposed within the safety cap 1078. By way of example, two such windows 1080 may recessed into the outer surface of safety cap 1078 and disposed at diametrically opposite sides thereof. Each such window 1080 may also be of any suitable shape (e.g., as a "plus sign" as shown) and include a transparent or translucent material to permit some degree of observation into the interior of safety cap 1078. If indeed it is verified that the plug or other component has structurally failed, the entire drill pipe segment 1060, with the safety cap 1078 still on, can be laid aside for as long as may be desired.

In accordance with one or more embodiments, there are potentially a great variety of ways to implement the use of "pre-charged" drill pipe segments as broadly contemplated herein. By way of an illustrative example, two to four interconnected drill pipe segments may initially be so configured (i.e., "pre-charged"), and initially stored vertically in a rig derrick or mast; e.g., they may be interconnected wherein an axially lowermost drill pipe segment includes a dissolvable plug (or analogous component) as described and illustrated herein, and large LCM objects can be then occupy volumetric space above the plug (or other analogous component). Further, the LCM objects so disposed may extend into the interior volumetric space of more than one drill pipe segment. Accordingly, when the deployment of a volume of large LCM objects is warranted or desired, the interconnected drill pipe segments can be picked up, added to a running drill string, and run downhole as part of the overall drill string.

In accordance with one or more embodiments, as a possible refinement, a second dissolvable plug, configured similarly to the dissolvable plugs described and illustrated herein, may be placed at an upper axial end of a drill pipe segment, or of an interconnected series of drill pipe segments. This can help retain the large LCM objects within the drill pipe segment(s) even more readily, and thus can also dissolve when drilling fluid propagates through the drill string.

In accordance with one or more embodiments, depending on the operating context at hand, large LCM objects and dissolvable plugs (or analogous components) may be installed into drill pipe segments as they are laid out horizontally and individually on a pipe deck, below the rig floor level. In this scenario, any and all "pre-charged" drill pipe segments (or interconnected series of drill pipe segments) may be picked up to the rig floor level and either made up into longer stands (series of drill pipe segments) and set back in the derrick for possible later use (e.g., as a contingency in the event of severe lost circulation) or added directly to a drill string for immediate use (e.g., when lost circulation may already be evident and problematic).

In accordance with one or more embodiments, "pre-charging" of one or more drill pipe segments (individually or connected in series) may be gravity-fed, making use of a rig hoist or crane to lift one end of the drill pipe segment(s), or by the use of a plunger or "rabbit", e.g., of a type that may already be in use to check and clean potential debris from the inside of the drill pipe segment(s), to push or pull the large LCM objects into position.

In accordance with one or more variant embodiments, the large LCM objects may be added to one or more drill pipe segments when manipulating the segment(s) from the rig floor level, by making use of a mouse-hole and single joint clamp and tugger hoist to facilitate pouring the large LCM objects into the drill pipe segment(s). Once "pre-charged", as noted above, the drill pipe segment(s) can be interconnected with one or more other segments to create to other joints to create a stand, and can then be set back in the derrick for future use, or could immediately be added to the drill string currently running-in-hole.

Figure 11:
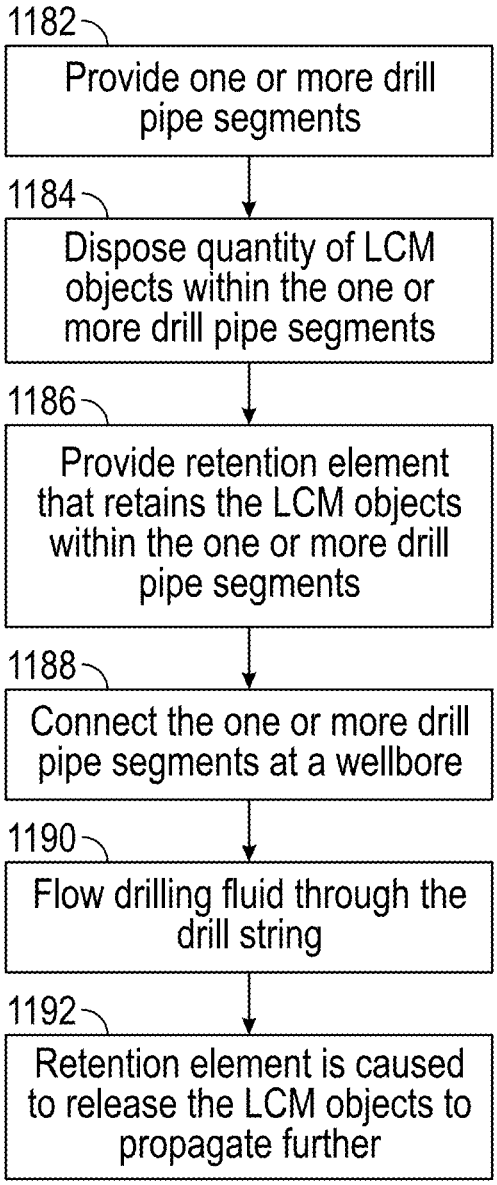
FIG. 11 illustrates a flowchart of a method in accordance with one or more embodiments.

FIG. 11 illustrates a flowchart of a method in accordance with one or more embodiments, as a general overview of steps which may be carried out in accordance with one or more embodiments described or contemplated herein.

As such, in accordance with one or more embodiments, one or more drill pipe segments are provided (1182). By way of illustrative example, this could involve a single drill pipe segment as variously described and illustrated herein, or two or more interconnected drill pipe segments (one of which could be a pup joint, as described and illustrated with respect to FIG. 8). A quantity of LCM objects are disposed within the one or more drill pipe segments (1184), and a retention element is provided that retains the LCM objects within the one or more drill pipe segments (1186). By way of illustrative example, the retention element could be embodied by a dissolvable plug as described and illustrated herein (e.g., with respect to FIGS. 3-5B, indicated at 364 or 564*a/b*), or by a capsule (e.g., as described and illustrated with respect to FIG. 6, indicated at 670) or sack (e.g., as described and illustrated with respect to FIG. 7, indicated at 772*a/b*).

In accordance with one or more embodiments, the one or more drill pipe segments are connected to a drill string at a wellbore (1188). Accordingly, as described herein, one or more drill pipe segments may be added or incorporated into a drill string such as that indicated at 236 in FIG. 2. Additionally, drilling fluid is flowed through the drill string (1190), e.g., as described and illustrated with respect to FIGS. 3B and 3C, wherein this causes the retention element to release the LCM objects to propagate further (1192). To the latter point, as described and illustrated herein, and merely by way of illustrative example, the drilling fluid may sufficiently saturate a retention element such as a dissolvable plug, capsule or sack such that LCM objects are able to then flow freely and uninhibitedly further into the drill string and/or into the wellbore.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A method comprising:

providing one or more preconfigured drill pipe segments including:

a quantity of lost circulation material objects disposed therewithin; and a dissolvable retention element that retains the lost circulation material objects within the one or more preconfigured drill pipe segments;

connecting the one or more preconfigured drill pipe segments to a drill string at a wellbore; and flowing drilling fluid through the one or more preconfigured drill pipe segments;

wherein the flowing of drilling fluid through the one or more preconfigured drill pipe segments causes the dissolvable retention element to structurally disintegrate and thereby release the lost circulation material objects to propagate further.

2. The method according to claim 1, wherein providing the one or more preconfigured drill pipe segments comprises interconnecting two or more drill pipe segments.

3. The method according to claim 2, wherein one of the preconfigured drill pipe segments comprises a pup joint.

4. The method according to claim 1, wherein:

providing the one or more preconfigured drill pipe segments comprises providing a drill pipe segment with first and second axial end portions, and an intermediate portion disposed between the first and second axial end portions;

wherein the intermediate portion has a larger diameter than the first and second axial end portions.

5. The method according to claim 1, wherein the dissolvable retention element structurally disintegrates in response to the flowing of drilling fluid through the one or more preconfigured drill pipe segments.

6. The method according to claim 5, wherein:

the dissolvable retention element comprises a plug; and providing the one or more preconfigured drill pipe segments comprises disposing the plug within the one or more drill pipe segments.

7. The method according to claim 6, wherein:

the plug defines first and second axial ends, and includes one or more channels disposed through the plug between the first and second axial ends; and flowing the drilling fluid comprises flowing the drilling fluid through the one or more channels disposed through the plug.

8. The method according to claim 6, wherein the plug is formed from one or more dissolvable materials.

9. The method according to claim 6, wherein the plug is formed from a powder material and a dissolvable binder material.

10. The method according to claim 6, further comprising:

providing an additional plug; and disposing the additional plug within the one or more preconfigured drill pipe segments, such that the quantity of lost circulation material objects is disposed between the plug and the additional plug.

11. The method according to claim 5, wherein:

the dissolvable retention element comprises a capsule formed from a dissolvable material; and providing the one or more preconfigured drill pipe segments comprises:

inflating the capsule; and disposing the inflated capsule within the one or more preconfigured drill pipe segments.

12. The method according to claim 5, wherein:

the dissolvable retention element comprises a sack formed from a dissolvable material; and providing the one or more preconfigured drill pipe segments comprises:

disposing at least a portion of the lost circulation material objects within the sack; and disposing the sack within the one or more preconfigured drill pipe segments.

13. The method according to claim 5, further comprising:

disposing a safety cap at an axial end of the one or more drill pipe segments.

14. The method according to 13, wherein the safety cap includes a window element that permits viewing into an interior of the safety cap.

15. The method according to claim 1, wherein a majority of the lost circulation material objects are each greater than 10 millimeters in diameter.

16. An apparatus for deploying lost circulation material objects into a wellbore, said apparatus comprising:

one or more preconfigured drill pipe segments including:

a quantity of lost circulation material objects disposed therewithin; and a dissolvable retention element that retains the lost circulation material objects within the one or more preconfigured drill pipe segments;

wherein flowing drilling fluid through the one or more preconfigured drill pipe segments causes the dissolvable retention element to structurally disintegrate and thereby release the lost circulation material objects to propagate further.

17. The apparatus according to claim 16, wherein the dissolvable retention element structurally disintegrates in response to the flowing of drilling fluid through the drill string.

18. The apparatus according to claim 17, wherein the dissolvable retention element comprises a plug disposed within the one or more preconfigured drill pipe segments.

19. The apparatus according to claim 17, further comprising a safety cap disposed at an axial end of the one or more preconfigured drill pipe segments.

20. A method comprising:

providing one or more preconfigured drill pipe segments including:

a quantity of lost circulation material objects disposed therewithin; and a dissolvable retention element that retains the lost circulation material objects within the one or more preconfigured drill pipe segments;

wherein flowing drilling fluid through the one or more preconfigured drill pipe segments causes the dissolvable retention element to structurally disintegrate and thereby release the lost circulation material objects to propagate further.

21. A method comprising:

providing one or more drill pipe segments;

disposing a quantity of lost circulation material objects within the one or more drill pipe segments;

providing a retention element that retains the lost circulation material objects within the one or more drill pipe segments;

connecting the one or more drill pipe segments to a drill string at a wellbore; and flowing drilling fluid through the drill string;

wherein the flowing of drilling fluid through the drill string causes the retention element to release the lost circulation material objects to propagate further, wherein providing a retention element comprises providing a dissolvable retention element that structurally disintegrates in response to the flowing of drilling fluid through the drill string, and wherein providing a dissolvable retention element comprises:

providing a plug formed from one or more dissolvable materials; and disposing the plug within the one or more drill pipe segments.

* * * * *